US012114739B2

(12) United States Patent
Zhang

(10) Patent No.: US 12,114,739 B2
(45) Date of Patent: Oct. 15, 2024

(54) WEBBING ADJUSTING BUCKLE

(71) Applicant: Ningbo Giga Fall Protection Equipment Co., Ltd., Ningbo (CN)

(72) Inventor: Yadi Zhang, Ningbo (CN)

(73) Assignee: Ningbo Giga Fall Protection Equipment Co., Ltd., Ningbo (CN)

( * ) Notice: Subject to any disclaimer, the term of this patent is extended or adjusted under 35 U.S.C. 154(b) by 0 days.

(21) Appl. No.: 18/129,255

(22) Filed: Mar. 31, 2023

(65) Prior Publication Data

US 2024/0260721 A1 Aug. 8, 2024

(30) Foreign Application Priority Data

Feb. 7, 2023 (CN) ..... 202320188268.7

(51) Int. Cl.
*A44B 11/08* (2006.01)

(52) U.S. Cl.
CPC ..... *A44B 11/08* (2013.01)

(58) Field of Classification Search
CPC . A44B 11/08; A44B 11/10; B60R 2022/1825; Y10T 24/4084; Y10T 24/4019
See application file for complete search history.

(56) References Cited

U.S. PATENT DOCUMENTS 2,754,560 A * 7/1956 Warner ..... B64D 17/32 24/196
3,293,713 A * 12/1966 Gaylord ..... A44B 11/10 24/196
3,591,900 A * 7/1971 Brown ..... A44B 11/10 24/196
4,130,255 A * 12/1978 Sasaki ..... B60R 22/34 297/483
4,608,735 A * 9/1986 Kasai ..... A44B 11/10 24/194
4,699,747 A * 10/1987 Lovato ..... A44B 11/10 264/328.8
4,903,378 A * 2/1990 Kasai ..... A44B 11/10 24/171
5,285,555 A * 2/1994 Bell ..... A44B 11/10 24/194
5,673,936 A * 10/1997 Mondel ..... B60R 22/24 297/483
7,004,695 B1 * 2/2006 Wen-Hsiang ..... B60P 7/0823 410/23

(Continued)

*Primary Examiner* — Robert Sandy
*Assistant Examiner* — Rowland Do
(74) *Attorney, Agent, or Firm* — Hemisphere Law, PLLC; Zhigang Ma

(57) ABSTRACT

A webbing adjusting buckle is provided. The webbing adjusting buckle includes a shell, a roller, and at least one limit locking member. The roller is arranged in the shell and is capable of rotating around an axis of the roller, as well as moving back and forth relative to the shell. The at least one limit locking member is movably assembled in the shell, and the limit locking member includes a limit column and an elastic member. The elastic member is arranged in a length direction of the limit column. A rotation limit structure is formed between the outer wall of the roller and the limit column, to allow the roller to rotate in one direction and prevent the roller from rotating reversely. The elastic member is used to provide the limit column with an elastic force towards the roller.

7 Claims, 6 Drawing Sheets

(56) References Cited

U.S. PATENT DOCUMENTS

| | | | | |
|---|---|---|---|---|
| 8,668,696 | B2 * | 3/2014 | Foerster | A61B 17/0401 24/171 |
| 11,338,766 | B2 * | 5/2022 | Wang | B60R 22/12 |
| 11,553,764 | B2 * | 1/2023 | Evans | A44B 11/10 |
| 2002/0014096 | A1 | 2/2002 | Kaneko et al. | |
| 2010/0125980 | A1 | 5/2010 | Zedel | |
| 2011/0016678 | A1 * | 1/2011 | Bergkvist | A44B 11/10 24/682.1 |
| 2014/0230195 | A1 * | 8/2014 | Ruge | A44B 11/10 29/3 |
| 2015/0107067 | A1 | 4/2015 | Zedel | |
| 2020/0114862 | A1 * | 4/2020 | Jaradi | B60R 22/24 |

* cited by examiner

WEBBING ADJUSTING BUCKLE

TECHNICAL FIELD

The present invention relates to the technical field of buckles, and in particular to a webbing adjusting buckle.

BACKGROUND

Buckles are widely used in daily life, especially in products such as safety harness. Buckles play a role in length adjustment, locking and clamping of webbing. Usually, a buckle includes a rectangular buckle frame and at least one cross bar located in the middle of the buckle frame, and a free end of the webbing is locked in various ways after bypassing the cross bar. For a structure with multiple cross bars or a single cross bar plus an external lock catch, the operation of adjusting the length of the webbing is relatively complex; and for a structure with a single cross bar, the safety risk of webbing slack exists. Therefore, structures with rotatable cross bars and able to tightly press the webbing have gradually appeared in the market, and the function of adjusting the length of the bypassing webbing is achieved by the rotation of the cross bars. However, this scheme will still impose safety risks, especially the possibility that the cross bars may rotate reversely and make the webbing slack, or even the risk that the webbing is drawn back and deviates from the cross bars.

SUMMARY

In view of the above problems in the prior art, the present invention provides a webbing adjusting buckle in order to overcome at least one of the above defects.

The present invention has the following specific technical solution:

A webbing adjusting buckle includes a shell, a roller, and at least one limit locking member. The shell is provided with a webbing connecting space. The roller is arranged in the shell and is capable of rotating around an axis of the roller, as well as moving back and forth relative to the shell. The middle part of the roller is located in the webbing connecting space, and both ends of the roller are extended into the shell, allowing a webbing of a seat belt to be mounted on the shell after bypassing the roller, and allowing the length of the webbing of the seat belt to be adjusted by rotating the roller. The at least one limit locking member is movably assembled in the shell, and the locking member moves in the same direction as the roller. The limit locking member includes a limit column and an elastic member. The limit column includes a first end and a second end opposite to each other, and the elastic member includes a first end and a second end opposite to each other. The elastic member is arranged in a length direction of the limit column, and the first end of the elastic member rests against the first end of the limit column. The second end of the elastic member rests against the shell. At least a part of the second end of the limit column rests against the outer wall of the roller, and a rotation limit structure is formed between the outer wall of the roller and the limit column, to allow the roller to rotate in one direction and prevent the roller from rotating reversely; and the elastic member is used to provide the limit column with an elastic force towards the roller.

In an embodiment, the outer wall of each end of the roller is circumferentially provided with a plurality of notches, at least a part of the second end of the limit column rests in the notches, and the length direction of the limit column is perpendicular to an axis direction of the roller to allow the roller to rotate in one direction and prevent the roller from rotating reversely.

In an embodiment, the cross section of the notches is V-shaped, each notch includes a limit surface and a guide surface adjacent to each other, and the guide surface has an arc transition. In a limited and clamped state, the upper end face of the limit column rests against the limit surface to clamp and prevent the roller from rotating reversely, the guide surface rests against the front end face of the limit column, and the limit column is pushed backward by the guide surface when the roller rotates; and the rotation limit structure is jointly formed by the notches and the front end of the limit column.

In an embodiment, the second end of the limit column facing to the roller is a square column structure.

In an embodiment, the elastic member is a spring.

In an embodiment, the webbing adjusting buckle includes two limit locking members that are symmetrically arranged. The shell is spliced by an upper shell and a lower shell. The upper shell and the lower shell cooperate to form the webbing connecting space, two mounting grooves, and two waist type through grooves. The webbing connecting space runs up and down. Two mounting grooves is used for accommodating the two limit locking members. The two waist type through grooves are adjacent to the mounting grooves respectively, and used for accommodating two ends of the roller respectively.

In an embodiment, the outer wall of the middle part of the roller is provided with a helically arranged anti-slip tooth structure.

The above technical solution has the following beneficial effects:

The webbing adjusting buckle includes a shell, a roller and a limit locking member, the limit locking member includes a limit column and an elastic member, and a rotation limit structure is formed between the outer wall of the roller and the limit column, so that the roller is allowed to rotate in one direction and prevented from rotating reversely, and the length of the webbing of the seat belt can be adjusted with the one-way rotation of the roller when the webbing is mounted on the shell after bypassing the roller; and due to the rotation limit structure, the webbing is prevented from being drawn back reversely, so that a self-locking function can be achieved to avoid the situation that the webbing is drawn back and even deviates from the roller, and the safety and reliability of the webbing adjusting buckle is effectively improved.

DETAILED DESCRIPTION

Figure 4:
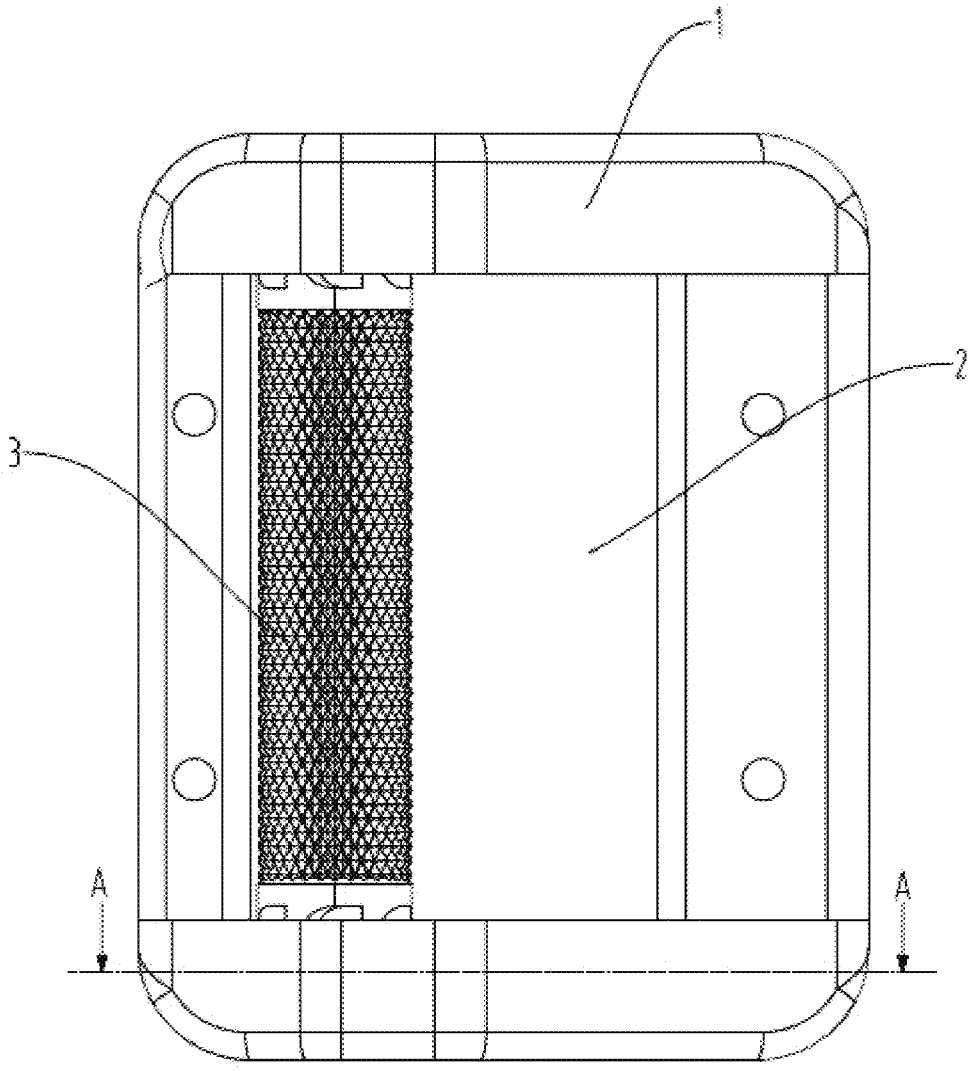
FIG. 4 is a top view of a webbing adjusting buckle of the present invention.

To easily understand the technical means, the creative feature, the object and the effect realized by the present invention, the present invention is further elaborated in the following embodiments in combination with drawings. The top-down direction shown on paper in FIG. 5 is defined as the top-down direction in the embodiments, and the left-to-right direction shown on paper in FIG. 4 is defined as the forward-to-backward direction in the embodiments.

As shown in FIG. 1 to FIG. 6, a webbing adjusting buckle provided by the present invention includes a shell 1 and a roller 3. A webbing connecting space 2 is formed on the shell 1, the roller 3 can be moved back and forth and arranged in the shell 1 rotationally around its own axis, the middle part of the roller 3 is located in the webbing connecting space 2, and both ends thereof are extended into the shell 1, so that a webbing of a seat belt can be mounted on the shell 1 after bypassing the roller 3, and the length of the webbing of the seat belt can be adjusted by rotating the roller 3.

Figure 3:
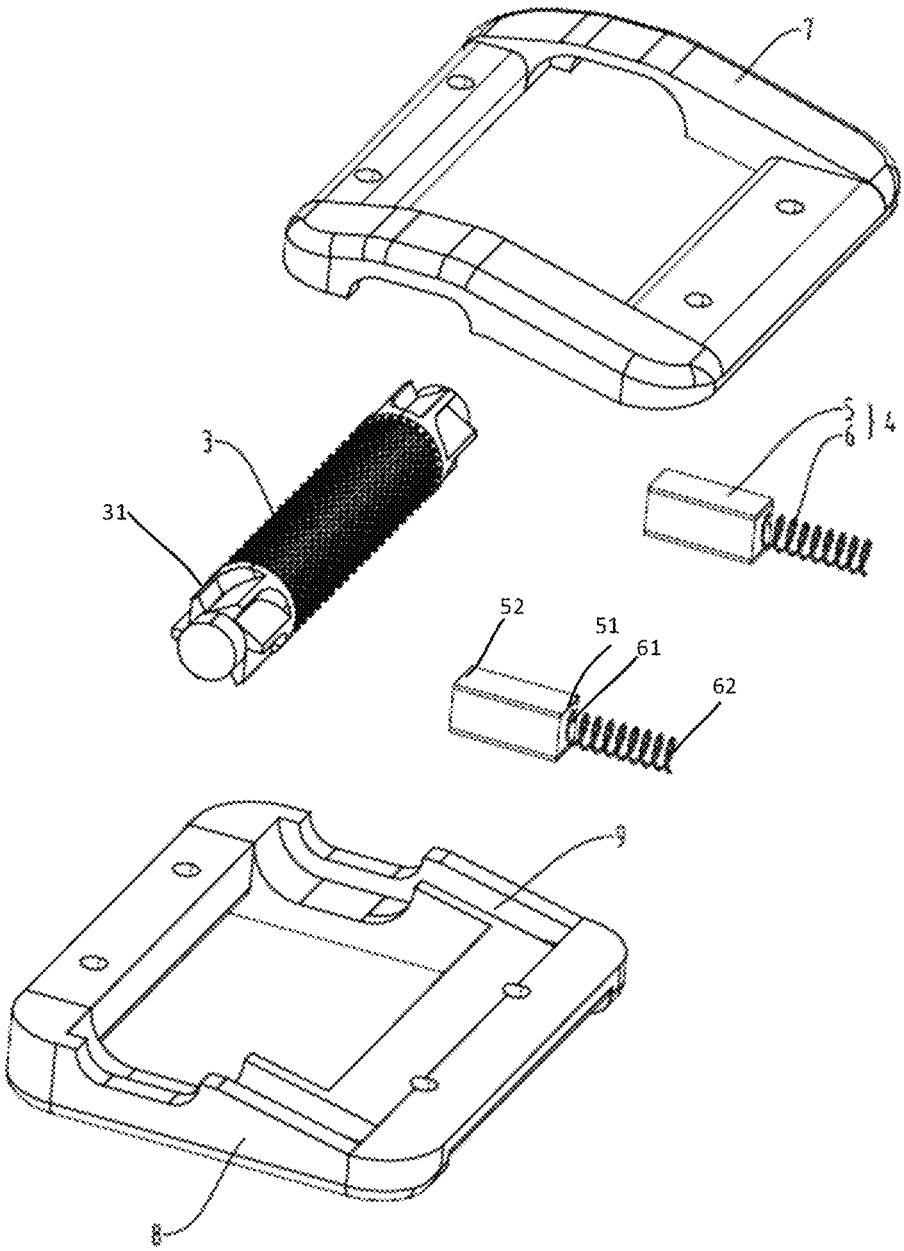
FIG. 3 is an exploded diagram of a webbing adjusting buckle of the present invention.

The webbing adjusting buckle further includes at least one limit locking member 4 which is movably assembled in the shell 1, and the limit locking member 4 includes a limit column 5 and an elastic member 6 which rest against each other in the front and back. Specifically, as shown in FIGS. 3 and 5, the locking member 4 moves in the same direction as the roller 3. The limit column 5 includes a first end 51 and a second end 52 opposite to each other, and the elastic member 6 includes a first end 61 and a second end 62 opposite to each other. The elastic member 6 is arranged in a length direction of the limit column 5, and the first end 61 of the elastic member 6 rests against the first end 51 of the limit column 5; the second end 62 of the elastic member 6 rests against the shell 1. At least a part of the second end 52 of the limit column 5 rests against an outer wall 31 of the roller 3, and a rotation limit structure is formed between the outer wall 31 of the roller 3 and the limit column 5 to allow the roller 3 to rotate in one direction and prevent the roller 3 from rotating reversely. The elastic member 6 is used to provide the limit column 5 with an elastic force towards the roller 3.

Figure 5:
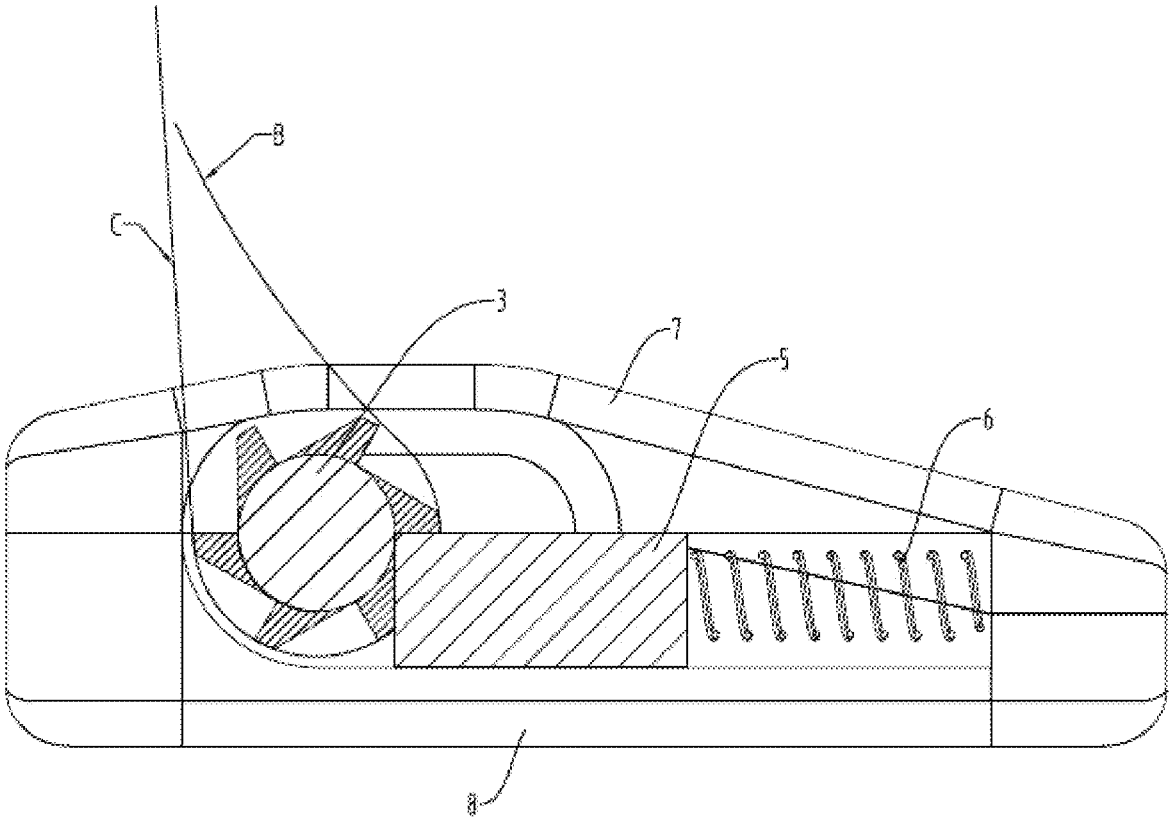
FIG. 5 is an A-A sectional view in FIG. 4.

In a specific application, as shown in FIG. 5, the length of the webbing of the seat belt can be adjusted with the one-way rotation of the roller 3 when the webbing is mounted after bypassing the roller 3, and the roller 3 is prevented from rotating reversely by the rotation limit structure, so that in a normal operation state, the roller 3 can be driven to rotate in one direction by pulling a free end B of the webbing, so as to drawn out the free end and reflect the action of tightening the seat belt. At the same time, as the roller 3 is prevented from rotating reversely, a self-locking function can be achieved to avoid the situation that the free end is drawn back and even deviates from the roller 3, and the safety and reliability of the webbing adjusting buckle is effectively improved. In addition, under the action that the outer wall of the roller 3 is always pressed by the limit locking member 4, a connecting end C of the webbing is always tightly pressed between the roller 3 and the side wall of the webbing connecting space 2; when the seat belt need to be loosened, the roller 3 can be manually pulled backwards by a user to make the connecting end of the webbing no longer in a tightly pressed state, and then the length of the webbing can be adjusted.

Based on the above technical solution, the webbing adjusting buckle includes a shell 1, a roller 3 and a limit locking member 4, the limit locking member 4 includes a limit column 5 and an elastic member 6, and a rotation limit structure is formed between the outer wall of the roller 3 and the limit column 5, so that the roller 3 is allowed to rotate in one direction and prevented from rotating reversely, and the length of the webbing of the seat belt can be adjusted with the one-way rotation of the roller 3 when the webbing is mounted after bypassing the roller 3; and due to the rotation limit structure, the webbing is prevented from being drawn back reversely, so that a self-locking function can be achieved to avoid the situation that the webbing is drawn back and even deviates from the roller 3, and the safety and reliability of the webbing adjusting buckle is effectively improved.

Figure 6:
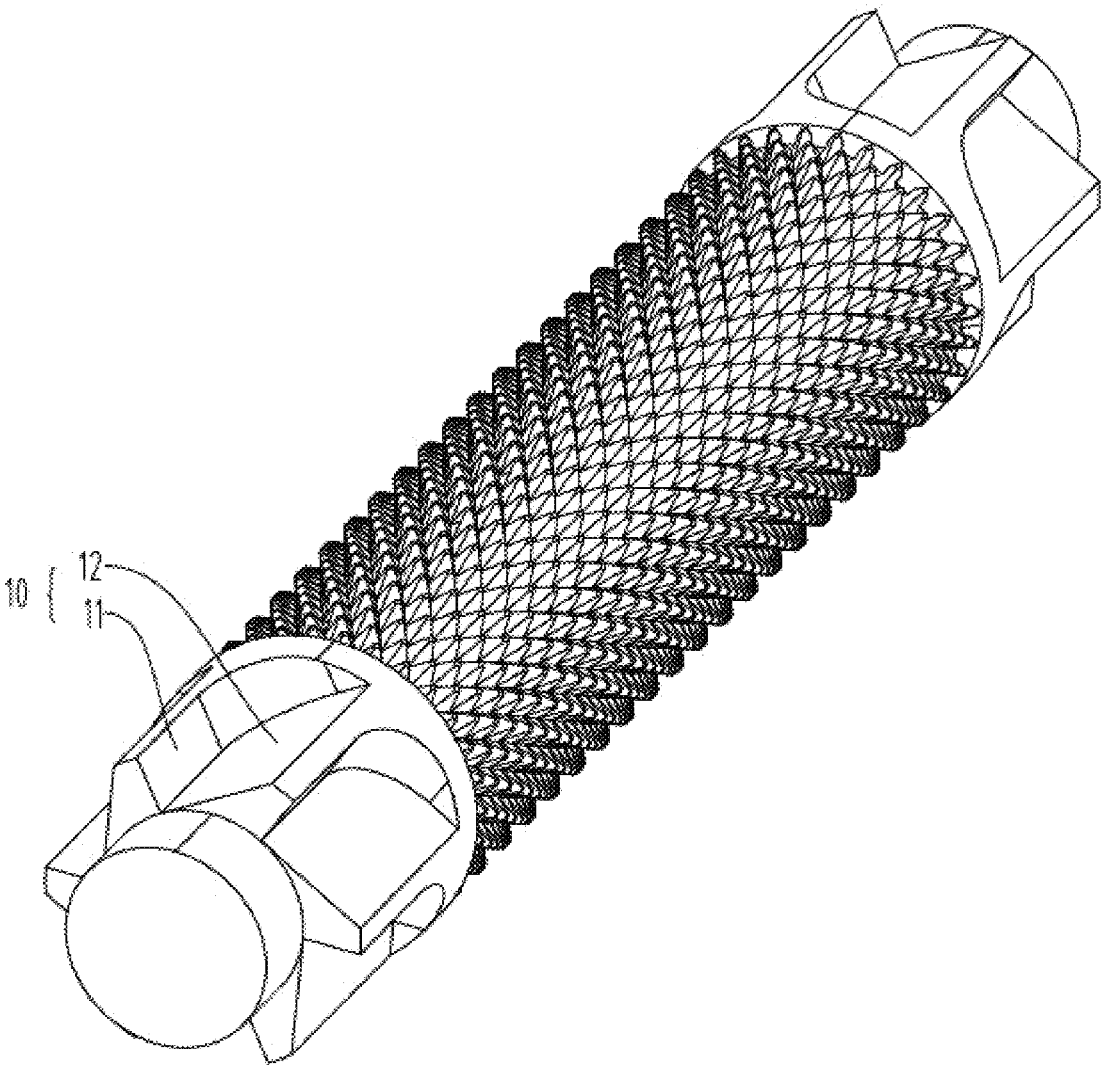
FIG. 6 is a three-dimensional diagram of a roller in a webbing adjusting buckle of the present invention.

In a preferred embodiment, as shown in FIG. 3, FIG. 5 and FIG. 6, the outer wall of each end of the roller 3 is circumferentially provided with a plurality of notches 10, at least a part of the second end of the limit column 5 rests in the notches 10, and the length direction of the limit column 5 is perpendicular to the axis direction of the roller 3 to allow the roller 3 to rotate in one direction and prevent the roller 3 from rotating reversely. Further, the cross section of the notches 10 is V-shaped, each notch 10 includes a limit surface 11 and a guide surface 12 adjacent to each other, and the guide surface 12 has an arc transition; in a limited and clamped state, the upper end face of the limit column 5 rests against the limit surface 11 to clamp and prevent the roller 3 from rotating reversely, the guide surface 12 rests against the front end face of the limit column 5, and the limit column 5 is pushed backward by the guide surface 12 when the roller 3 rotates; and the rotation limit structure is jointly formed by the notches 10 and the front end of the limit column 5. When the roller 3 is in a stationary state, i.e., the limit surface 11 is clamped by the upper end face of the limit column 5, the front end of the limit column 5 is driven by the elastic member 6 to push the guide surface 12; as the roller 3 cannot be pushed to rotate reversely, the roller 3 is further pushed forward by the limit column 5, so that the roller 3 is forced close to the front side wall of the webbing connecting space 2 to tightly press the webbing. In an embodiment, the second end 52 of the limit column 5 facing to the roller 3 is a square column structure. Further, the elastic member 6 is a spring; but obviously, a conventional member with elasticity, including but not limited to an elastic rubber column, can also be used.

Figure 1:
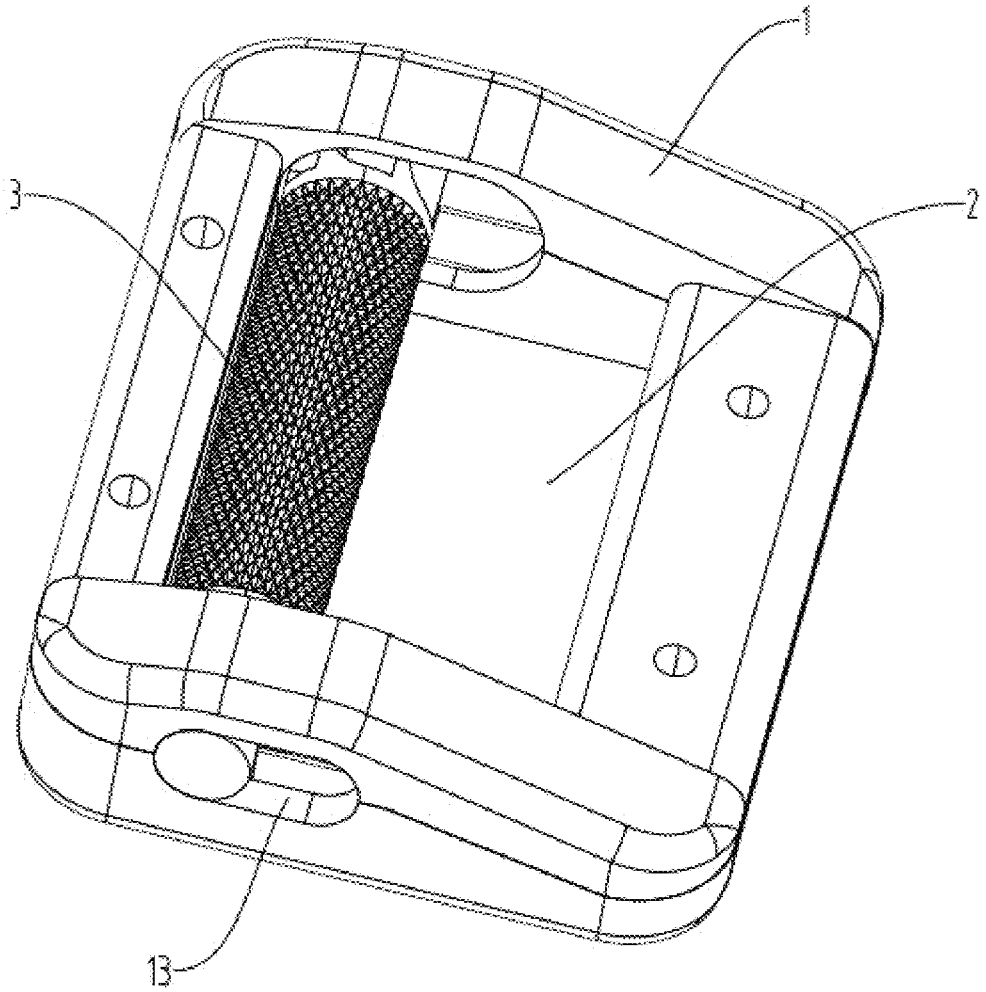
FIG. 1 is a three-dimensional diagram of a webbing adjusting buckle of the present invention.
Figure 2:
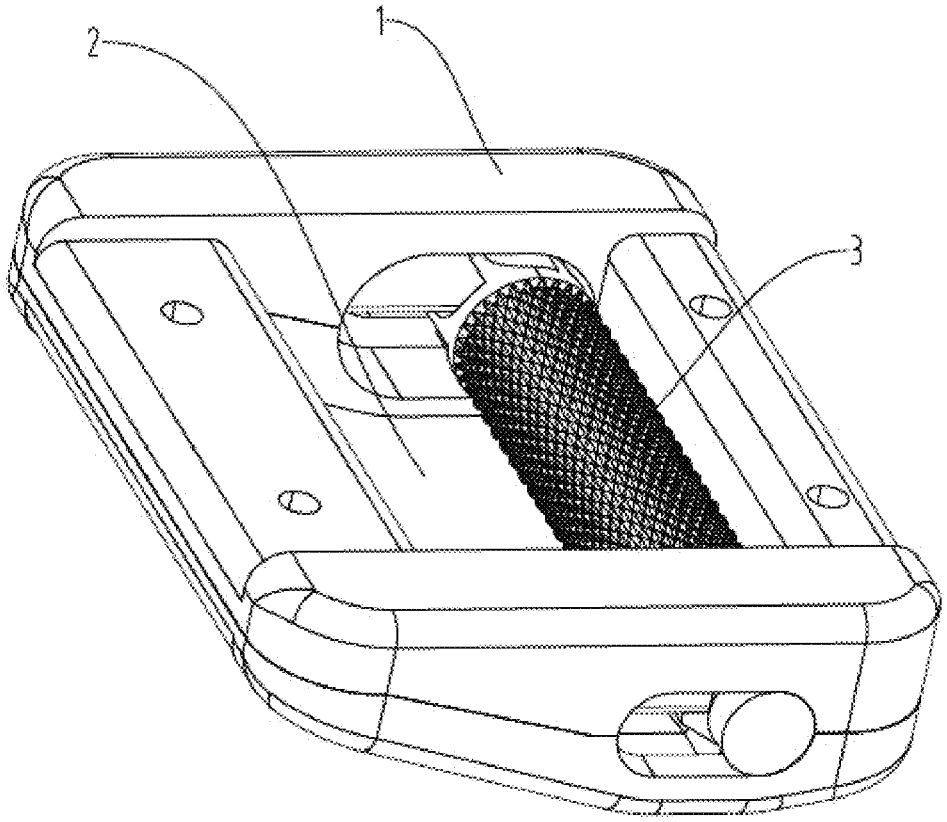
FIG. 2 is a three-dimensional diagram from another view of a webbing adjusting buckle of the present invention.

As a further preferred embodiment, specifically as shown in FIG. 1 to FIG. 3, the webbing adjusting buckle includes two limit locking members 4 that are symmetrically arranged, the shell 1 is spliced by an upper shell 7 and a lower shell 8. The upper shell 7 and the lower shell 8 cooperate to form the webbing connecting space 2, two mounting grooves 9, and two waist type through grooves 13, which are used as assembly spaces. The webbing connecting space 2 runs up and down. The two mounting grooves 9 is used for accommodating the two limit locking members 4. The two waist type through grooves 13 are adjacent to the mounting grooves 9 respectively, and used for accommodating two ends of the roller 3 respectively. Among which, the mounting grooves 9 allow the limit column 5 and the elastic member 6 to move back and forth, and the waist type through grooves 13 allow the roller 3 to move back and forth. Further, the outer wall of the middle part of the roller 3 is provided with a helically arranged anti-slip tooth structure.

The above is just preferred embodiments of the present invention, and is only intended to illustrate rather than limiting the present invention. Those skilled in the art shall understand that many changes, modifications or even equivalents can be made within the spirit and scope defined by the claims of the present invention, and all of which will fall into the protection scope of the present invention.

The invention claimed is:

1. A webbing adjusting buckle, comprising:

a shell (1), wherein the shell (1) is provided with a webbing connecting space (2);

a roller (3) arranged in the shell (1) and be capable of rotating around an axis of the roller (3), as well as moving back and forth relative to the shell (1); wherein the middle part of the roller (3) is located in the webbing connecting space (2), and both ends of the e roller (3) are extended into the shell (1), allowing a webbing of a seat belt to be mounted on the shell (1) after bypassing the roller (3), and allowing the length of the webbing of the seat belt to be adjusted by rotating the roller (3); and at least one limit locking member (4) movably assembled in the shell (1), wherein the locking member (4) moves in the same direction as the roller (3); the limit locking member (4) comprises a limit column (5) and an elastic member (6); the limit column (5) comprises a first end and a second end opposite to each other, and the elastic member (6) comprises a first end and a second end opposite to each other;

wherein the elastic member (6) is arranged in a length direction of the limit column (5), and the first end of the elastic member (6) rests against the first end of the limit column (5); the second end of the elastic member (6) rests against the shell (1);

wherein at least a part of the second end of the limit column (5) rests against an outer wall of the roller (3), and a rotation limit structure is formed between the outer wall of the roller (3) and the limit column (5), to allow the roller (3) to rotate in one direction and prevent the roller (3) from rotating reversely;

and the elastic member (6) is used to provide the limit column (5) with an elastic force towards the roller (3).

2. The webbing adjusting buckle according to claim 1, wherein the outer wall of each end of the roller (3) is circumferentially provided with a plurality of notches (10), at least a part of the second end of the limit column (5) rests in the notches (10), and the length direction of the limit column (5) is perpendicular to an axis direction of the roller (3) to allow the roller (3) to rotate in one direction and prevent the roller (3) from rotating reversely.

3. The webbing adjusting buckle according to claim 2, wherein the cross section of the notches (10) is V-shaped, each notch (10) comprises a limit surface (11) and a guide surface (12) adjacent to each other, and the guide surface (12) has an arc transition;

in a limited and clamped state, the upper end face of the limit column (5) rests against the limit surface (11) to clamp and prevent the roller (3) from rotating reversely, the guide surface (12) rests against the front end face of the limit column (5), and the limit column (5) is pushed backward by the guide surface (12) when the roller (3) rotates; and the rotation limit structure is jointly formed by the notches (10) and the front end of the limit column (5).

4. The webbing adjusting buckle according to claim 3, wherein the second end of the limit column (5) facing to the roller (3) is a square column structure.

5. The webbing adjusting buckle according to claim 1, wherein the elastic member (6) is a spring.

6. The webbing adjusting buckle according to claim 1, wherein the webbing adjusting buckle comprises two limit locking members (4) that are symmetrically arranged, the shell (1) is spliced by an upper shell (7) and a lower shell (8); the upper shell (7) and the lower shell (8) cooperate to form the webbing connecting space (2), two mounting grooves (9), and two waist type through grooves (13); wherein the webbing connecting space (2) runs up and down; the two mounting grooves (9) is used for accommodating the two limit locking members (4); and the two waist type through grooves (13) are adjacent to the mounting grooves (9) respectively, and used for accommodating two ends of the roller (3) respectively.

7. The webbing adjusting buckle according to claim 1, wherein the outer wall of the middle part of the roller (3) is provided with a helically arranged anti-slip tooth structure.

* * * * *